US005775285A

United States Patent [19]

Takahashi

[11] Patent Number: 5,775,285

[45] Date of Patent: Jul. 7, 1998

[54] OIL FILTER ARRANGEMENT FOR ENGINE

[75] Inventor: Masanori Takahashi, Hamamatsu, Japan

[73] Assignee: Sanshin Kogyo Kabushiki Kaisha, Hamamatsu, Japan

[21] Appl. No.: 720,424

[22] Filed: Sep. 30, 1996

[30] Foreign Application Priority Data

Sep. 29, 1995 [JP] Japan ..... 7-253561

[51] Int. Cl.[6] ..... F01M 11/03

[52] U.S. Cl. ..... 123/196 A; 123/196 W

[58] Field of Search ..... 123/196 A, 196 W, 123/196 R, 195 HC

[56] References Cited

U.S. PATENT DOCUMENTS

| | | | |
|---|---|---|---|
| 5,199,395 | 4/1993 | Mizumura et al. | 123/196 A |
| 5,452,695 | 9/1995 | Bedi | 123/196 A |
| 5,558,058 | 9/1996 | Ming et al. | 123/196 A |

FOREIGN PATENT DOCUMENTS

| | | | |
|---|---|---|---|
| 2-298618 | 12/1990 | Japan | 123/196 A |
| 6-129224 | 5/1994 | Japan | 123/196 R |
| 6-185334 | 7/1994 | Japan | 123/196 A |
| 6-193418 | 7/1994 | Japan | 123/196 A |
| 6-323120 | 11/1994 | Japan | 123/196 A |

*Primary Examiner*—Erick R. Solis
*Attorney, Agent, or Firm*—Knobbe, Martens, Olson & Bear LLP

[57] ABSTRACT

An internal combustion engine that includes an induction system and oil filter that are disposed, at least in part, on the same side of the cylinder block. The induction system is configured so as to clear the oil filter so as to facilitate its servicing.

16 Claims, 4 Drawing Sheets

OIL FILTER ARRANGEMENT FOR ENGINE

BACKGROUND OF THE INVENTION

This invention relates to an oil filter arrangement for an engine and particularly to an engine and oil filter arrangement particularly adapted for use in outboard motors.

As is well known, it is the practice to employ an oil filter for filtering the oil for four-cycle internal combustion engines. Although the concept is simple, the actual positioning of the oil filter can provide significant problems, particularly in certain types of applications for internal combustion engines.

The oil filter should be located in an area where it can be conveniently serviced. However, it should also be positioned in a location where the oil flowing to the oil filter will be disposed close to or at the beginning of the mail oil gallery that supplies the oil to the various components of the engine. That is, the oil filter should be disposed fairly close to the oil pump so that it will be capable of filtering contaminants from the oil before they can be circulated to any component of the engine which is lubricated. In addition, it is desirable to position the oil filter in a location where it can be easily serviced.

Generally, such an oil filter location is chosen on one side of the cylinder block in proximity to the main oil gallery and at the beginning of this main oil gallery. However, there are also a number of other components which frequently are disposed in this same general area. Thus, it is important to ensure that the oil filter is located in such a manner that it can be easily serviced.

Certain particular applications for engine require some components which are normally disposed in spaced location from the cylinder block to be disposed so that they extend along a side of the cylinder block. For example, with overhead valve, four-cycle engines, and in certain applications, the intake system, including the manifold runners and a plenum or surge chamber which serves the runners, are located at least in part along one side of the cylinder block. This is done for space conservation purposes and to permit the desired runner length.

For example, in outboard motors, where the engine is mounted normally so hat the crankshaft rotates about a vertically extending axis, the intake system is frequently tucked along one side of the cylinder block in order to permit the requisite manifold runner length and to conserve space. The use of a conventional intake manifold extending transversely outwardly from the side of the cylinder head would result in too wide a protective cowling and outboard motor. In fact, this same problem can also exist with automotive or other vehicle applications. In these applications, the desire to provide a low hood line may necessitate or dictate the positioning of the induction system on one side of the engine. Obviously, the positioning of the induction system along one side of the cylinder block can interfere with the accessibility of the oil filter.

It is, therefore, a principal object of this invention to provide an improved engine construction and oil filter and intake system arrangement.

It is a further object of this invention to provide an improved engine construction embodying an oil filter and side positioned induction system wherein the components are configured so as to facilitate servicing.

It is a further object of this invention to provide an improved engine and oil filter arrangement for an outboard motor or other application for engines where space is at a premium.

SUMMARY OF THE INVENTION

This invention is adapted to be embodied in an internal combustion engine that is comprised of a cylinder block forming at least one cylinder bore. A cylinder head is affixed relative to the cylinder block and closes one end of the cylinder bore at one end of the cylinder block. A crankcase chamber is formed at the other end of the cylinder bore by a crankcase member that is affixed to this other end of the cylinder block. A crankshaft is rotatably journaled in the crankcase chamber about a crankshaft axis and is driven by a piston that reciprocates in the cylinder bore. At least one intake port is formed in one side of the cylinder head for delivering an intake charge to the cylinder bore. An intake system for supplying an intake charge to the intake port is affixed relative to the engine on the one side of the cylinder block. The intake system is comprised of a plenum chamber lying on one side of the cylinder block, and an intake runner extending from the plenum chamber to the cylinder head intake port. An oil gallery is formed in the one side of the cylinder block for circulating oil to components of the engine for their lubrication. An oil filter is mounted on the one side of the cylinder block and communicates with the oil gallery for filtering oil delivered to the oil gallery. The plenum chamber and manifold runner are configured so as to clear the oil filter so that it can be serviced.

DETAILED DESCRIPTION OF THE PREFERRED EMBODIMENTS OF THE INVENTION

Figure 1:
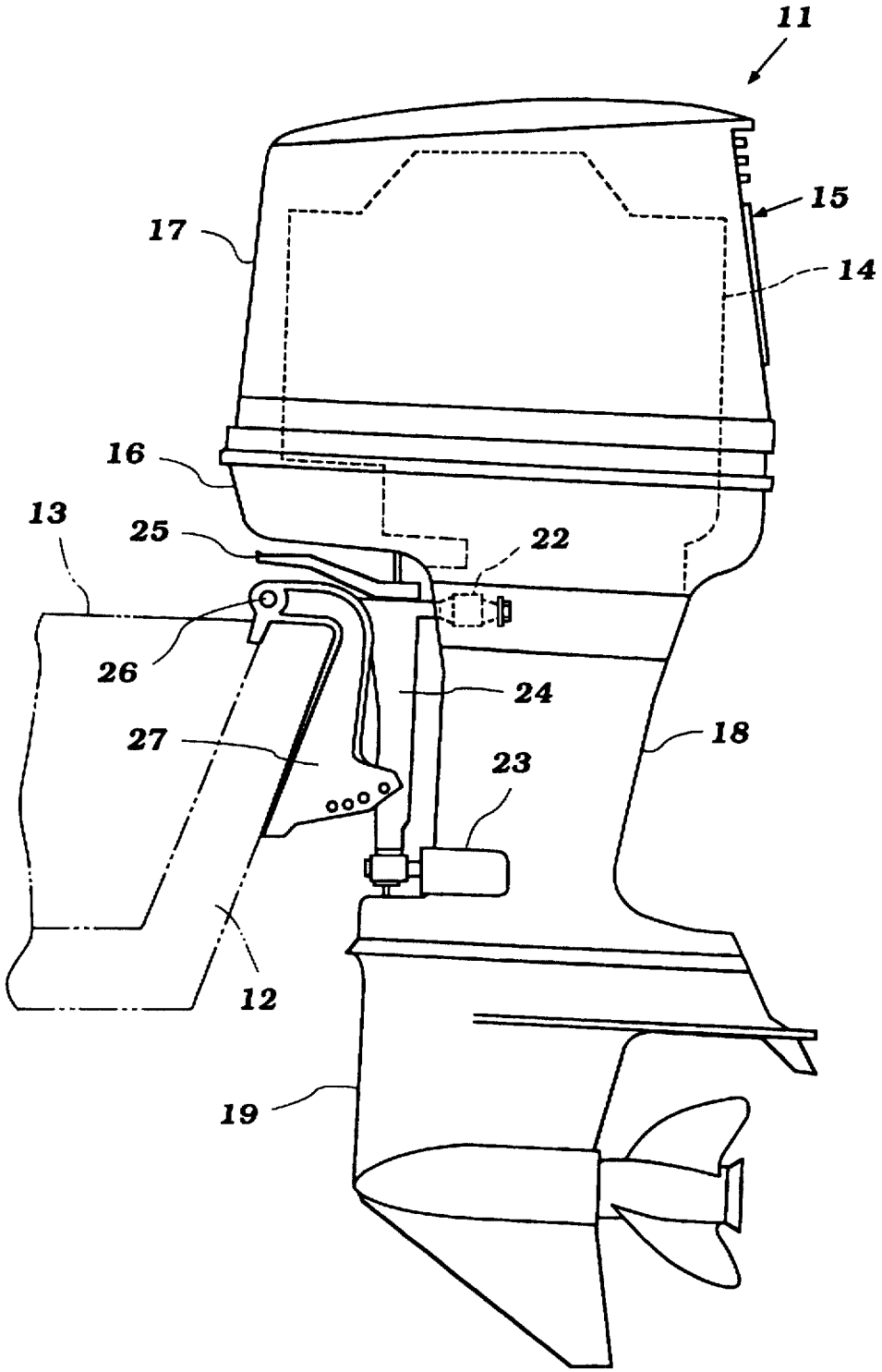
FIG. 1 is a side elevational view of an outboard motor constructed in accordance with an embodiment of the invention, shown attached to the transom of watercraft, which is illustrated partially and in phantom.

Referring now in detail to the drawings and initially to FIG. 1, an outboard motor constructed in accordance with an embodiment of the invention is identified generally by the reference numeral 11 and is shown as attached to a transom 12 of a watercraft, indicated generally by the reference numeral 13 and which is shown in phantom. The invention is described in conjunction with an outboard motor such as the outboard 11 because the invention has particularly utility and marine propulsion systems such as outboard motors because of their compact construction and spacial requirements. It will be apparent, however, to those skilled in the art that certain facts of the invention may be utilized with other types of applications for internal combustion engines.

The outboard motor 11 is comprised of a powerhead that consists of powering internal combustion engine 14 and a surrounding protective cowling, indicated generally by the reference numeral 15. This cowling includes a lower tray portion 16 which is formed from a rigid lightweight material such as aluminum or aluminum alloy. An upper main cowling portion 17 is detachably connected to the tray 16 in a known manner. The main cowling portion 17 is preferably formed from an even lighter weight material than the tray 16 such as a molded fiberglass reinforced resin or the like.

As will become apparent by reference to the remaining figures, the engine 14 is mounted in the powerhead so that its output shaft, a crankshaft, rotates about a vertically extending axis, as is typical with outboard motor practice. This is done so as to facilitate connection between the engine output shaft and a drive shaft (not shown). The drive shaft depends from the powerhead through a drive shaft housing 18 and into a lower unit 19. There the drive shaft drives a propeller shaft (not shown) through a conventional bevel gear reversing transmission. A propeller 21 is affixed to the propeller shaft for propelling the watercraft 13 in a well known manner.

A steering shaft (not shown) is connected by means of an upper bracket assembly 22 and lower bracket assembly 23 to the drive shaft housing 18. This steering shaft is, in turn, journaled within a swivel bracket 24 for steering of the outboard motor 11 about a vertically extending steering axis defined by this steering shaft. A tiller 25 is affixed to the upper end of the steering shaft for steering of the outboard motor 11 in a known manner.

A pivot pin 26 connects the swivel bracket 24 to a clamping bracket 27. The clamping bracket 27 is, in turn, affixed to the watercraft transom 12 in a manner known in the art. Pivotal movement about the pivot pin 26 permits tilt and trim movement of the outboard motor 11 as is well known in this art.

The invention deals primarily with the construction of the engine 14 and particularly its induction and oil filtering system. Therefore, further details of the construction of the outboard motor 11 except for the portions of the protective cowling 15, as will be referred to later, are not believed to be necessary to permit those skilled in the art to practice the invention. Therefore, where any component of the outboard motor 11 has not been depicted or described, reference may be had to any conventional construction for those details. Also, the invention is being described in conjunction with an outboard motor because it has particular utility in conjunction with such applications. This is because the invention deals, as should be apparent from the foregoing description, with the induction system and oil filter location that permit ease of servicing without compromising the functioning of either the induction system or the lubrication system. Thus, the invention may also be utilized in other applications where these criteria are required.

Figure 3:
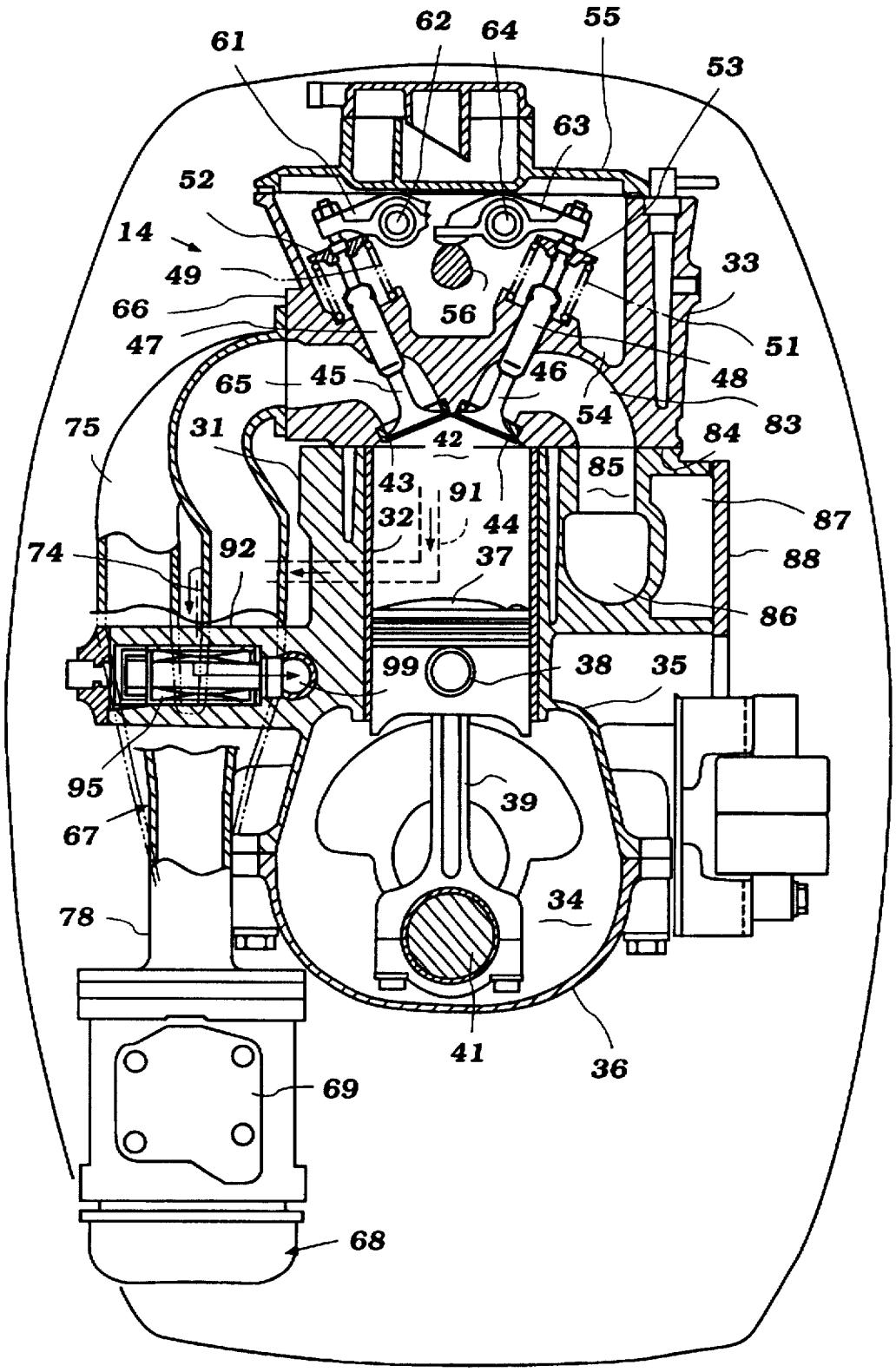
FIG. 3 is a top plan view of the powerhead, with the protective cowling shown only in outline, and with portions of the engine broken away to more clearly show the construction.

Referring now in detail primarily to the remaining figures and initially primarily to FIG. 3, it will be seen that the engine 14 is comprised of a cylinder block 31 that is formed, in the illustrated embodiment, with two aligned cylinder bores, indicated by the reference numeral 32. Although the invention is described in conjunction with a two-cylinder in-line type engine, it will be readily apparent to those skilled in the art how the invention can be practiced with engines having other cylinder numbers or other cylinder configurations.

The cylinder bores 31 are closed at one end thereof and at one end of the cylinder block 31 by a cylinder head assembly 33 that is affixed thereto in a known manner. A crankcase chamber 34 is formed at the other end of the cylinder block 31 and closes the lower ends of the cylinder bores 32 by means of a skirt 35 of the cylinder block 31 and a crankcase member 36 that is affixed thereto in a known manner.

Pistons 37 reciprocate in the cylinder bores 32 and are connected by means of piston pins 38 to the upper or small ends of connecting rods 39. The lower or big ends of the connecting rods 39 are journaled on the throws of a crankshaft 41 that is rotatably journaled in the crankcase chamber 34. The rotational journaling for the crankshaft 41 may be of any type known in the art.

The cylinder head assembly 31 is formed with individual recesses 42, each of which cooperate with a respective one of the cylinder bores 32 and the heads of the pistons 37 to form the combustion chambers for the engine 14. At times the recesses 42 will be referred to as the "combustion chambers." This is because they comprise the major portion of the combustion chamber volume at top dead center.

Intake ports 43 and exhaust ports 44 are formed by valve seats pressed cast or otherwise secured into the cylinder head assembly 33. Intake and exhaust valves 45 and 46 are mounted in respective guides 47 and 48 for reciprocation within the cylinder head assembly 31 for opening and closing the respective intake and exhaust ports 43 and 44.

The intake and exhaust valves 45 and 46 are urged to their closed positions by means of coil compression springs 49 and 51. These springs 49 and 51 bear against machined surfaces of the cylinder head assembly 33 and keeper retainer assemblies 52 and 53 that are affixed to the stems of the intake and exhaust valves 45 and 46 for holding the valves in their closed positions.

Figure 2:
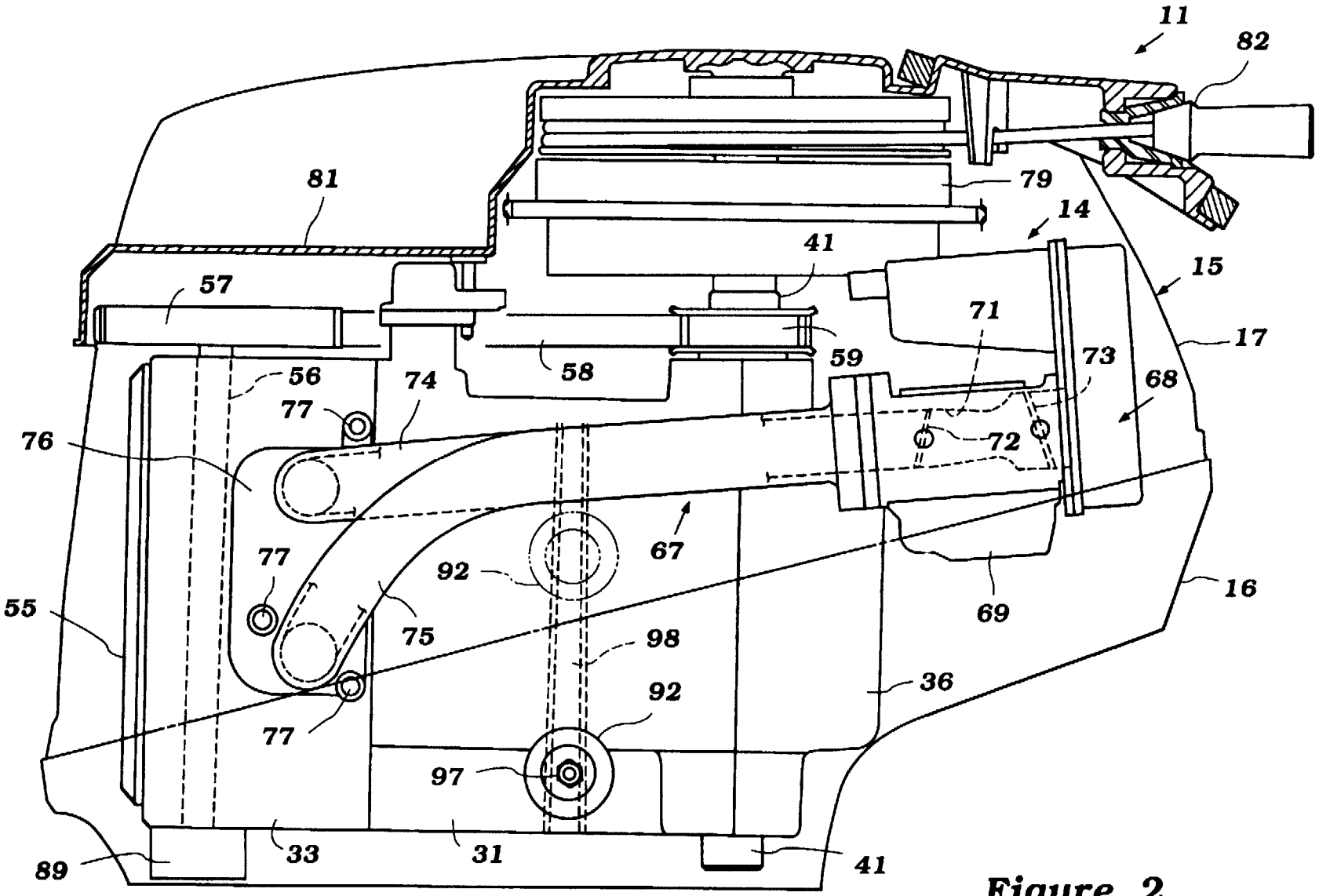
FIG. 2 is an enlarged side elevational view of the powerhead of the outboard motor, looking in the direction opposite to FIG. 1, and with portions broken away and shown in section.

This portion of the valve mechanism as thus far described is contained primarily in a cam chamber 54 that is closed by a cam cover 55 which is affixed to and forms a part of the cylinder head assembly 33. A single overhead camshaft 56 is rotatably journaled in the cylinder head assembly 33 in a known manner. A driving sprocket 57 (FIG. 2) is affixed to the upper end of the camshaft 56, which extends above and through the upper portion of the cylinder head assembly 33. A toothed timing belt 58 is entrained around the sprocket 57 and a driving sprocket 59 that is affixed to the upper end of the engine crankshaft 41. This drive arrangement drives the camshaft 56 at one-half crankshaft speed, as is well known in this art.

The camshaft 56 has individual cam lobes that contact intake rocker arms 61 that are journaled on a rocker arm shaft 62 for operating the intake valves 45 in a well-known manner. In a similar manner, the camshaft 56 has exhaust cam lobes that cooperate with exhaust rocker arms 63 journaled on an exhaust rocker arm shaft 64. The rocker arm shaft 64 is suitably affixed or journaled in the cylinder head assembly 33 and operates to open the exhaust valves 46.

Figure 4:
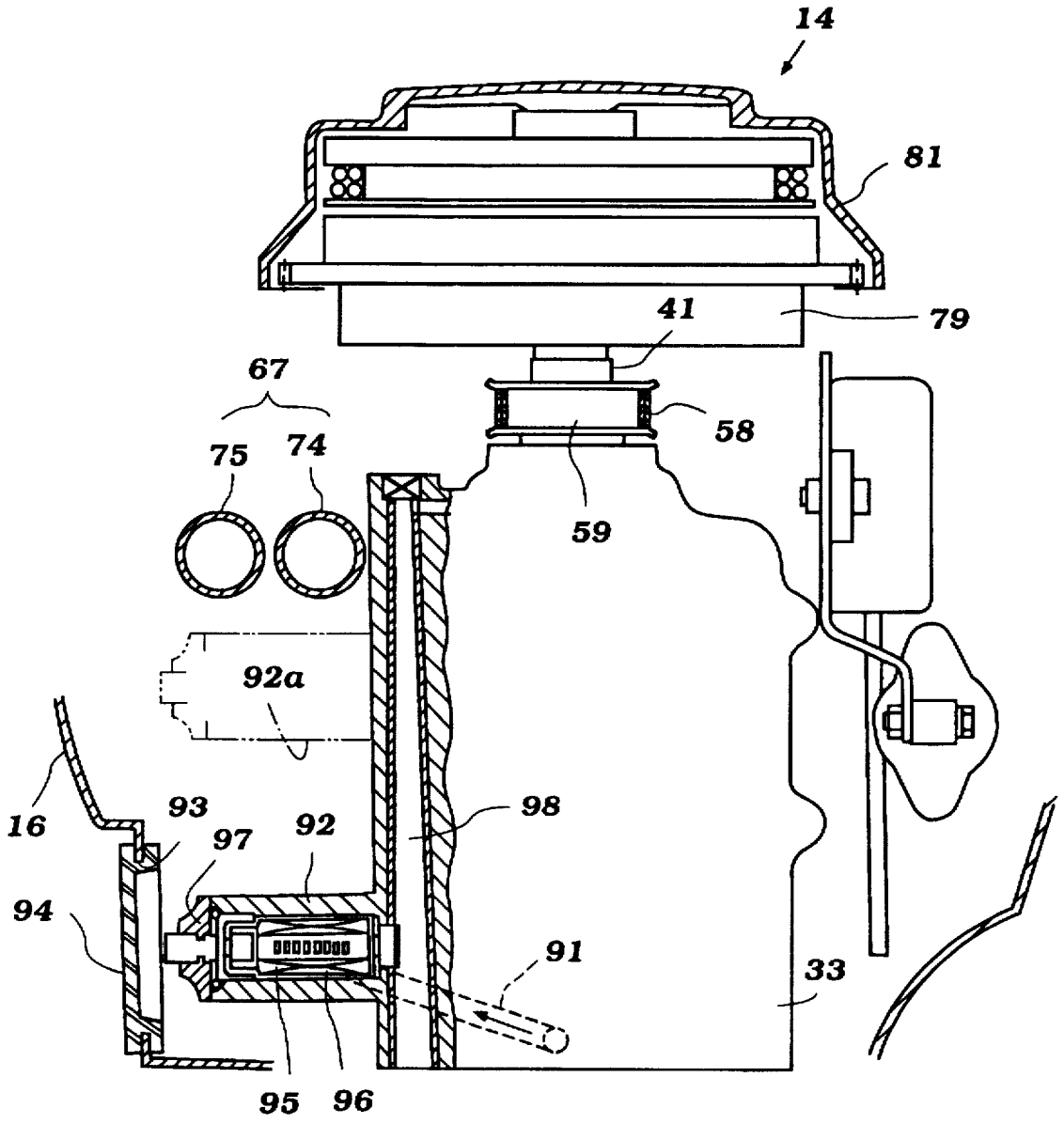
FIG. 4 is a partial side elevational view looking in a direction perpendicular to FIG. 2, with portions broken away and shown in section so as to more clearly reveal how the oil filter element can be accessed for servicing.

The intake ports 43 are formed at the termination of intake passages 65 that extend from port openings in one side 66 of the cylinder head assembly 33. An induction system, indicated generally by the reference numeral 67, is provided for supplying a fuel-air charge to the combustion chambers of the engine, and specifically the cylinder bores 32, through these intake passages 65. The induction system 67 is shown best in FIGS. 2 and 3, although portions of it appear also in FIG. 4.

This induction system includes an air intake device and plenum chamber, indicated generally by the reference numeral 68, that receives an air charge which has been admitted into the protective cowling 15 through a suitable atmospheric air inlet. This inlet and plenum device 68 then delivers the air to a charge former 69 which is, in the illustrated embodiment, a side-draft carburetor, having a passage 71 in which a throttle valve 72 and a choke valve 73 are positioned. The intake passage 71 communicates with a common portion 78 of a pair of manifold runners 74 and 75, each of which branch from this common portion 78 and extend along one side of the cylinder block 31. These runners terminate in a flange section 76 that is affixed to the cylinder head side 66 by means of fasteners 77.

It will be noted that the charger former 69 and intake and plenum device 68 are disposed in spaced relationship from the cylinder block 31 on the intake side thereof and extend beyond the crankcase member 36. This is done so as to provide the requisite length for the manifold runners 74 and 75 and associated intake passages 71 of the charge former 69 to provide good induction efficiency. The volume of the plenum chamber 68 may be appropriately chosen so as to provide the desired intake tuning.

It will also be seen that the runners 74 and 75 curve in a generally upward direction, as seen in side elevation, so that they pass in generally side-by-side relationship, as shown in FIG. 3, before they turn to enter the respective sides of the charge former. Although the arrangement has been described in conjunction with a single carburetor, the invention can be used with either a single-barrel or dual side-draft type of carburetor, depending upon the desired performance. Also, the invention may be utilized with engines having fuel injection systems, either direct or manifold type.

The charge which is admitted to the combustion chambers 42 by the induction system 67 is fired by means of spark plugs (not shown) that are mounted in the cylinder head assembly 33. These spark plugs have their gaps extending into the combustion chamber recesses 42, as is well known in this art. A flywheel magneto 79 may be affixed to the upper end of the crankshaft 41 for supplying electrical power for firing the spark plugs, as is known in the art. This flywheel magneto is covered by a cover assembly 81, which may also provide a recoil type starter 82 that cooperates with the flywheel 79 in a known manner for pull-starting of the engine.

The burnt charge exits the combustion chambers through the exhaust ports 44 to flow into exhaust passages 83 formed in the cylinder head 33. These exhaust passages 83 curve downwardly and exit through a lower surface 84 of the cylinder head assembly 33. There, exhaust manifold runners 85, formed integrally in the cylinder block 31, collect these exhaust gases and deliver them to a collector section 86. This collector section 86 extends downwardly for discharge of the exhaust gases to the atmosphere through any known type of exhaust system as normally utilized with outboard motors.

The engine is provided with cooling jackets for its water cooling. One of these cooling jackets is indicated at 87, and is formed adjacent the exhaust manifold runners 85 and collector section 86. A closure plate 88 closes this jacket 87. Water for cooling the engine is circulated through this cooling jacket and others of the engine in any appropriate manner.

The engine 14 is also provided with a lubricating system. This lubricating system includes a lubricant pump 89 (FIG. 2) that is driven in an appropriate manner, for example, off the lower end of the camshaft 56. This pump 89 draws lubricant from a lubricant tank contained within the drive shaft housing 18 through a suitable conduit and delivers it to a main supply conduit 91 (FIGS. 3 and 4) that is formed in the cylinder head assembly 33 and cylinder block 31 through drilled passages. These passages terminate in a boss 92 formed on the intake side of the cylinder block 31 at a position below the manifold runners 74 and 75.

In one preferred embodiment, the boss 92 is formed adjacent the tray 16, and specifically, an access opening 93 formed therein. This access opening 93 is closed by a removable grommet 94. Alternatively, the boss 92 may be formed at a higher location, as indicated at **92*a* in FIGS. 2 and 4. In this case, the boss 92*a* can be accessed by removing the main cowling portion 17**.

The boss 92 forms a chamber 95 that communicates with the drilled passage 91 for admission of lubricant thereto. A removable filter element 96 of the radial flow type is contained within the chamber 95 and held in place by a closure 97. The filter element 96 has a central discharge that communicates with a main oil gallery 98 that extends through the cylinder block 31 and which is intersected by various drilled or cast-in passages for delivering lubricant to, among other things, the main bearings for the crankshaft 41, and to the camshaft 56 and elements in the cam chamber 54.

Although the invention has been described in conjunction with a removable cartridge type oil filter, it should be readily apparent that the invention may also be utilized in conjunction with throw-away type filters.

Thus, from the foregoing description, it should be readily apparent that the described construction permits an effective and efficient intake manifold system and lubricating system, that are both positioned on the same side of the engine and wherein the oil filter may be easily accessed for servicing. Of course, the foregoing description is that of preferred embodiments of the invention, and various changes and modifications may be made without departing from the spirit and scope of the invention, as defined by the appended claims.

What is claimed is:

1. An internal combustion engine comprised of a cylinder block forming a plurality of cylinder bores, a cylinder head affixed relative to said cylinder block and closing one end of said cylinder bores at one end thereof, a crankcase chamber formed at the other end of said cylinder bore by a crankcase member affixed to said cylinder block, a crankshaft rotatable journaled within said crankcase chamber and driven by pistons reciprocating in said cylinder bores, a plurality of inlet ports formed in one side of said cylinder head at least one for each cylinder bore, an induction system for supplying a charge to said intake ports, said induction system comprising a plenum chamber lying on said one side of said cylinder block and a plurality of intake runners each extending from said plenum chamber to a respective of said cylinder head intake ports, an oil gallery formed in said one side of said cylinder block, and an oil filter mounted on said one side of said cylinder block at a point in general alignment with at least one of said intake ports and spaced therefrom for filtering oil delivered to said oil gallery, said oil filter and said induction system being configured so as to facilitate servicing of said oil filter by having at least some of said intake runners curved to pass around said oil filter.

2. An internal combustion engine as set forth in claim 1, wherein the oil gallery is the mail oil gallery for the engine.

3. An internal combustion engine as set forth in claim 1, further including a throttle valve for controlling the air flow to the engine through the induction system, said throttle valve being positioned adjacent the one side of the cylinder block.

4. An internal combustion engine as set forth in claim 3, wherein at least some of the intake runners are curved to pass around the oil filter.

5. An internal combustion engine as set forth in claim 1, wherein the oil gallery is the main oil gallery for the engine.

6. An internal combustion engine as set forth in claim 1, wherein the engine is disposed so that the crankshaft rotates about a vertically extending axis.

7. An internal combustion engine as set forth in claim 6, in combination with an outboard motor wherein the engine forms a portion of the powerhead of the outboard motor and drives a propulsion device positioned in a lower unit of the outboard motor.

8. An internal combustion engine as set forth in claim 7, wherein the outboard motor further includes a protective cowling encircling the engine.

9. An internal combustion engine as set forth in claim 8, wherein the cylinder head has a plurality of inlet ports formed in one side thereof at least one for each cylinder bore, and an induction system for supplying a charge to said intake ports said induction system comprising a plenum chamber lying on said one side of said cylinder block and a plurality of intake runners each extending from said plenum chamber to a respective of said cylinder head intake ports, an oil gallery formed in said one side of said cylinder block, and the oil filter is mounted on said one side of said cylinder block at a point in general alignment with one of said intake ports and spaced therefrom.

10. An internal combustion engine as set forth in claim 9, wherein at least some of the intake runners are curved to pass around the oil filter.

11. An internal combustion engine as set forth in claim 10, wherein the oil gallery is the mail oil gallery for the engine.

12. An internal combustion engine as set forth in claim 9, further including a throttle valve for controlling the air flow to the engine through the induction system, said throttle valve being positioned adjacent the one side of the cylinder block.

13. An internal combustion engine as set forth in claim 12, wherein at least some of the intake runners are curved to pass around the oil filter.

14. An outboard motor including a powerhead having an internal combustion engine comprised of a cylinder block forming a plurality of cylinder bores, a cylinder head affixed relative to said cylinder block and closing one end of said cylinder bores at one end thereof, a crankcase chamber formed at the other end of said cylinder bore by a crankcase member affixed to said cylinder block, a crankshaft rotatable journaled within said crankcase chamber for rotation about a vertically extending axis and driven by pistons reciprocating in said cylinder bores, an oil filter mounted on said one side of said engine for filtering lubricating oil circulated through said engine, and a protective cowling encircling said engine, said protective cowling forming an access opening for accessing said oil filter without removal of the entire protective cowling.

15. An internal combustion engine as set forth in claim 14, wherein the protective cowling comprises a lower tray portion and an upper main cowling portion.

16. An internal combustion engine as set forth in claim 15, wherein the access opening is formed in the lower tray portion.

* * * * *